US011519110B2

(12) United States Patent
Hanson Allen et al.

(10) Patent No.: US 11,519,110 B2
(45) Date of Patent: Dec. 6, 2022

(54) GARMENTS WITH INTEGRATED GRIPPING TECHNOLOGY

(71) Applicant: Spanx, LLC, Atlanta, GA (US)

(72) Inventors: Wendy Hanson Allen, Atlanta, GA (US); Deneb Torano, Atlanta, GA (US); Mayur Vansia, Atlanta, GA (US); Natalie Weirtz, Atlanta, GA (US); Angelica Melendez, Atlanta, GA (US); Sara Blakely, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 62 days.

(21) Appl. No.: 15/962,132

(22) Filed: Apr. 25, 2018

(65) Prior Publication Data

US 2019/0330773 A1 Oct. 31, 2019

(51) Int. Cl.

| | |
|---|---|
| ***D04B 21/18*** | (2006.01) |
| ***A41D 31/00*** | (2019.01) |
| ***A41C 1/00*** | (2006.01) |
| ***A41B 9/04*** | (2006.01) |

(52) U.S. Cl.

CPC ..... *D04B 21/18* (2013.01); *A41B 9/04* (2013.01); *A41C 1/003* (2013.01); *A41D 31/00* (2013.01); *A41B 2400/82* (2013.01); *A41B 2500/10* (2013.01); *A41D 2300/22* (2013.01); *A41D 2400/82* (2013.01); *A41D 2500/10* (2013.01); *D10B 2401/061* (2013.01); *D10B 2501/06* (2013.01)

(58) Field of Classification Search

CPC . A41B 9/00; D04B 21/18; D04B 1/18; D04B 21/207; D10B 2401/061; D10B 2501/06; D10B 2401/06; D10B 2403/0114; A41D 31/00; A41D 2400/82; A41D 2500/10; A41D 2300/22; A41D 31/18

See application file for complete search history.

(56) References Cited

U.S. PATENT DOCUMENTS

| | | | |
|---|---|---|---|
| 1,531,814 | A | 3/1925 | Reynolds |
| 1,755,827 | A | 4/1930 | Kops |
| 1,811,843 | A | 6/1931 | Chisholm |
| 1,891,775 | A | 12/1932 | Neilson |

(Continued)

OTHER PUBLICATIONS

Co-pending U.S. Appl. No. 15/967,803, filed May 1, 2018.

(Continued)

*Primary Examiner* — Jennifer A Steele

(74) *Attorney, Agent, or Firm* — Meunier Carlin & Curfman LLC

(57) ABSTRACT

The garments disclosed herein have integrated gripping technology to grip the body of the wearer over large interior surfaces. The distribution of gripping technology throughout the garment gives increased freedom of body movement and reduces bulkiness over conventional garments, while also allowing for free cut edges. Furthermore, the dispersion of the gripping technology over the majority of the garment eliminates the problem of polymer strips and beading digging into the skin. Slip garment embodiments are disclosed herein that include a lower region having an interior surface with exposed elastic threads configured to directly contact the wearer. The slip garment embodiments include a free-cut lower edge. The slip garment embodiments can be constructed using cut and sew methods.

22 Claims, 8 Drawing Sheets

(56) References Cited

U.S. PATENT DOCUMENTS

| | | | | |
|---|---|---|---|---|
| 1,944,591 | A | 1/1934 | Brown | |
| 2,107,121 | A | 2/1938 | Kops | |
| 2,579,547 | A | 12/1951 | Cadous | |
| 2,598,172 | A | 5/1952 | Humphlett | |
| 2,809,673 | A * | 10/1957 | McMurray | D03D 23/00 139/423 |
| 3,069,885 | A * | 12/1962 | Cooper | D04B 21/18 66/195 |
| 3,595,243 | A | 7/1971 | Mount | |
| 3,710,599 | A * | 1/1973 | Sarmiento | D04B 21/00 66/193 |
| 4,307,587 | A * | 12/1981 | Baesgen | D04B 21/18 66/195 |
| 5,885,910 | A | 3/1999 | Graichen | |
| 6,446,471 | B1 * | 9/2002 | Kaplancali | D04B 21/18 66/192 |
| 6,871,516 | B2 * | 3/2005 | Peeler | D04B 1/106 66/171 |
| D567,370 | S | 4/2008 | Mortensen et al. | |
| D572,910 | S | 7/2008 | Schreiner | |
| 7,611,999 | B2 | 11/2009 | McMurray | |
| D718,918 | S | 12/2014 | Wexler | |
| D726,393 | S | 4/2015 | Wexler | |
| D760,479 | S | 7/2016 | Adrovic | |
| D770,727 | S | 11/2016 | Brown | |
| 9,565,877 | B2 | 2/2017 | Martinet et al. | |
| D798,030 | S | 9/2017 | Ketcham | |
| D798,539 | S | 10/2017 | Holmes | |
| D801,638 | S | 11/2017 | Curran | |
| D812,853 | S | 3/2018 | Harris | |
| 9,936,739 | B2 | 4/2018 | Smith | |
| D816,951 | S | 8/2018 | Stearns | |
| D827,250 | S | 9/2018 | Sandieson et al. | |
| D837,483 | S | 1/2019 | Anayiotos | |
| 10,660,373 | B2 | 5/2020 | Martin | |
| D922,735 | S | 6/2021 | Holmes | |
| 2002/0104334 | A1 * | 8/2002 | Metzler | A41B 11/14 66/178 R |
| 2003/0110551 | A1 * | 6/2003 | Lazarian | A41B 11/14 2/409 |
| 2006/0276103 | A1 | 12/2006 | Teng | |
| 2007/0079419 | A1 | 4/2007 | Spruill | |
| 2007/0238392 | A1 | 10/2007 | Starbuck et al. | |
| 2007/0251636 | A1 | 11/2007 | Herbert | |
| 2008/0032580 | A1 * | 2/2008 | Fukuoka | D04B 1/18 442/306 |
| 2008/0261490 | A1 | 10/2008 | Scheininger et al. | |
| 2008/0261491 | A1 | 10/2008 | Scheininger et al. | |
| 2009/0300816 | A1 | 12/2009 | Brito et al. | |
| 2011/0003533 | A1 | 1/2011 | Caruso | |
| 2011/0209262 | A1 | 9/2011 | Waldman | |
| 2012/0060253 | A1 | 3/2012 | Bergin | |
| 2012/0190260 | A1 * | 7/2012 | Morishita | D04B 21/18 442/301 |
| 2013/0095730 | A1 * | 4/2013 | Jensen | A41C 1/003 450/95 |
| 2014/0173808 | A1 * | 6/2014 | Collins | A41B 11/00 2/239 |
| 2014/0311187 | A1 * | 10/2014 | Amarasiriwardena | D04B 1/26 66/178 R |
| 2015/0101099 | A1 | 4/2015 | Zhong | |
| 2015/0128653 | A1 * | 5/2015 | Yeung | D04B 21/16 66/195 |
| 2015/0196064 | A1 * | 7/2015 | Melarti | A41B 9/04 450/95 |
| 2016/0135512 | A1 | 5/2016 | Smith | |
| 2016/0157529 | A1 | 6/2016 | Hoeven | |
| 2016/0201237 | A1 * | 7/2016 | Li | A41C 3/12 450/93 |
| 2016/0235129 | A1 | 8/2016 | Jackson | |
| 2018/0116306 | A1 | 5/2018 | Andre | |
| 2020/0107587 | A1 | 4/2020 | Martin | |
| 2020/0323278 | A1 | 10/2020 | Roddis | |

OTHER PUBLICATIONS

Office Action issued for U.S. Appl. No. 16/570,525, dated Apr. 28, 2021.

Maternilysewing, "How to Add Fabric to the Side of a Shirt," Jul. 2018,https://www.maternitysewing.com/how-to-add-abric-side-shirt/ (Year: 2018). 24 pages.

Office Action issued for U.S. Appl. No. 29/663,289, dated Oct. 13, 2021.

Office Action issued for U.S. Appl. No. 16/570,525, dated Oct. 8, 2021.

Office Action issued for U.S. Appl. No. 16/570,525, dated Nov. 25, 2020.

* cited by examiner

GARMENTS WITH INTEGRATED GRIPPING TECHNOLOGY

BACKGROUND

Many types of clothing have a tendency to slip out of place during wear. Examples include shapewear, intimate apparel, and legwear such as leggings, hosiery, and socks. To solve these issues, gripping technology may be applied to the garment, for example, via application of a polymer strip or bead (such as a strip of silicone). For example, the lower edges of slips are conventionally kept in place via application of gripping polymer strips or beads to prevent the garment from riding up on the wearer's leg. However, this hinders the natural movement of the body as it is only applied to the edge of the garment. Conventional polymer strips and beading create bulk, and the polymer can create uncomfortably high friction. Furthermore, the lack of breathability at the polymer strip or bead can cause excessive sweating.

SUMMARY OF THE INVENTION

The garments disclosed herein grip the body of the wearer over large interior surfaces as opposed to at point locations defined by polymer strips or beading. The distribution of gripping technology throughout the garment gives increased freedom of body movement and reduces bulkiness over conventional garments, while also allowing for free cut edges. Furthermore, the dispersion of the gripping technology over the majority of the garment eliminates the problem of polymer strips and beading digging into the skin.

The garments disclosed herein include a free-cut lower edge and a lower region extending upward from the lower edge. The lower region has an interior surface with exposed elastic threads that directly contact the body of a wearer, and is devoid of any coatings having a higher coefficient of friction than the interior surface. The entire lower region can, in some embodiments, be devoid of horizontal seams or adhesives. In some embodiments, the interior surface that includes the exposed elastic threads can extend around the entire lower region. The garments may also include middle regions positioned above the lower regions. The middle regions can be attached to waistbands and, in some embodiments, can include friction-reducing layers to cover the exposed elastic threads.

The lower region having the exposed elastic threads can be a knit fabric, for example, a warp knit, a circular knit, or a double knit fabric. The lower region can be constructed using cut and sew methods. In some embodiments, the lower region is formed of a single layer of fabric. The lower region can be comprised of from about 30% to about 85% elastane, including about 45% elastane.

The fabric having exposed elastic threads has higher coefficients of friction than most fabrics. For example, the static coefficient of friction in the warp direction can be from about 0.9 to about 3.0. The kinetic coefficient of friction in the warp direction can be from about 0.9 to about 3.0. The static coefficient of friction in the weft direction can be from about 0.9 to about 3.0, and the kinetic coefficient of friction in the weft direction can be from about 0.9 to about 3.0.

In some embodiments, the lower region of the garment has an elongation of from about 30% to about 200% in the width direction at a 100 Newton (N) load. The lower region can exert a tension force in the width direction of from about 1 N to about 30 N at 30% elongation, of from about 2 N to about 40 N at 50% elongation, and from about 3 N to about 60 N at 70% elongation. In the length direction, the lower region can have an elongation of from about 30% to about 200% at a 100 N load. The lower region can exert a tension force in the length direction of from about 1 N to about 30 N at 30% elongation, of from about 2 N to about 40 N at 50% elongation, and from about 3 N to about 60 N at 70% elongation.

Methods of making the garments with integrated gripping technology are disclosed herein. The methods include knitting elastic threads into a fabric such that the elastic threads are exposed on a surface of the fabric, cutting one or more panels from the fabric having exposed elastic threads, and attaching the one or more panels to other components of the garment such that the exposed elastic threads are positioned on the interior surface of the garment. In some embodiments, the fabric panel having the exposed elastic threads forms the lower region of the garment. In some embodiments, the fabric panel having the exposed elastic threads forms both the lower region and the middle region of the garment. The methods can also include attaching a superior edge of the middle region to a waistband and/or applying a friction reducing layer to a portion of the fabric panel. The elastic threads can be knit using warp knitting methods. In some embodiments, panels of fabric having exposed elastic threads are cut from a larger piece of fabric. The panel of fabric having exposed elastic threads can be attached to other components of the garment with seams, using cut and sew methods.

DETAILED DESCRIPTION

Figure 1:
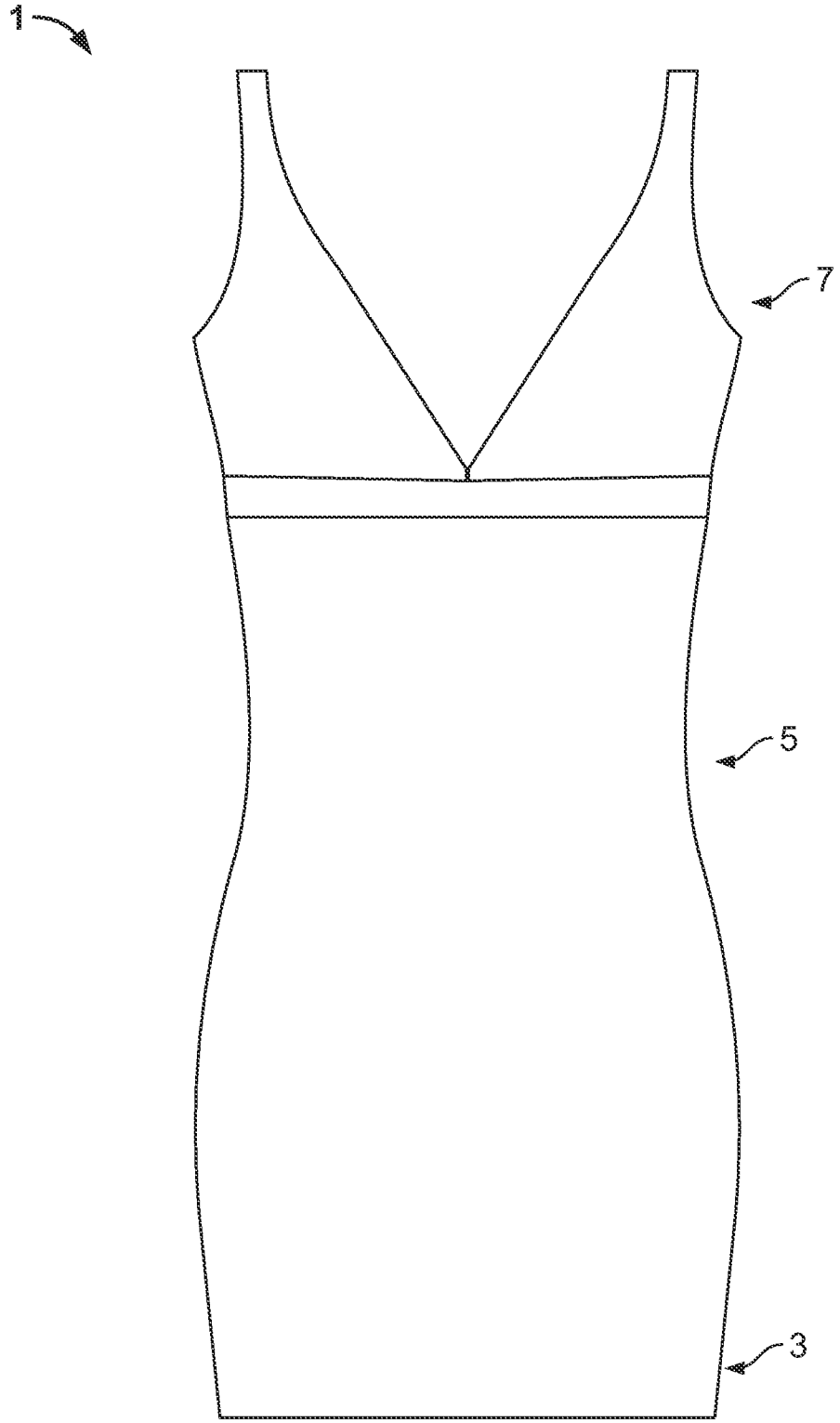
FIG. 1 shows the outside front of a full slip embodiment with integrated gripping technology.

The gripping fabric disclosed herein has gripping technology built into the body of the garment. This enables the garment to grip the body over large areas as opposed to at point locations defined by the application of polymer strips or beading. Gripping is facilitated by exposing high friction, elastic threads to interior surfaces of the garment, such that they directly contact the body. The distribution of gripping technology throughout the garment allows the garment to stretch evenly, giving increased freedom of body movement over conventional technology. The integration of the gripping technology into the fabric also reduces bulkiness and allows for free cut edges, giving the garment a lightweight appeal. Furthermore, while conventional gripping technologies uncomfortably bind and dig into the skin, the dispersion of the gripping technology over the majority of the garment eliminates this discomfort.

The principles and technologies disclosed herein will be described in the context of a slip. However, a slip is just one example embodiment of a garment that can benefit from the disclosed gripping technology. It is envisioned that the gripping technology could be incorporated into any garment that could benefit from reduced sliding or movement against the body, including, but not limited to: shapewear (such as, for example, midthigh shapers, camisoles, tank tops, bodysuits, waistcinchers, briefs, thongs, boyshorts, girlshorts, shapesuits, rompers, and tunics), intimate apparel (such as, for example, bras, panties, camis, tank tops, and bodysuits), and legwear (such as, for example, leggings, hosiery, and socks).

This description may refer to certain aspects of the garment relative to other aspects of the garment or to the body of a wearer. As used herein, superior indicates a direction that is closer to the wearer's head. Inferior indicates a direction that is closer to the wearer's feet. Upward, upper, or uppermost indicates a superior direction, or toward a wearer's head. Downward, lower, or lowermost indicates an inferior direction, or toward a wearer's feet. Middle indicates a position between inferior and superior, or between upper and lower.

A slip is an undergarment worn beneath a dress or skirt to help it hang smoothly, reduce static cling, and to prevent chafing of the skin from coarse fabrics. Slips are also worn for warmth, and to protect fine fabrics from perspiration. Slips can also be used to prevent undergarments from showing through, or for preventing the silhouette of the legs showing through clothing when standing in front of a bright light source. Keeping the lower edge of a slip in place is desirable to prevent bunching and ensure that the slip performs the functions listed above. However, keeping the lower edge of the slip in place necessitates the use of gripping technology, as described above. Conventional gripping technologies utilize polymer (such as silicone) strips or beading applied adjacent to the lower edge, but these are undesirable because they hinder the natural movement of the body, create bulk, and generate uncomfortably high friction against the skin. They also are not air permeable, and can cause sweating and blistering at the point of application.

Figure 2:
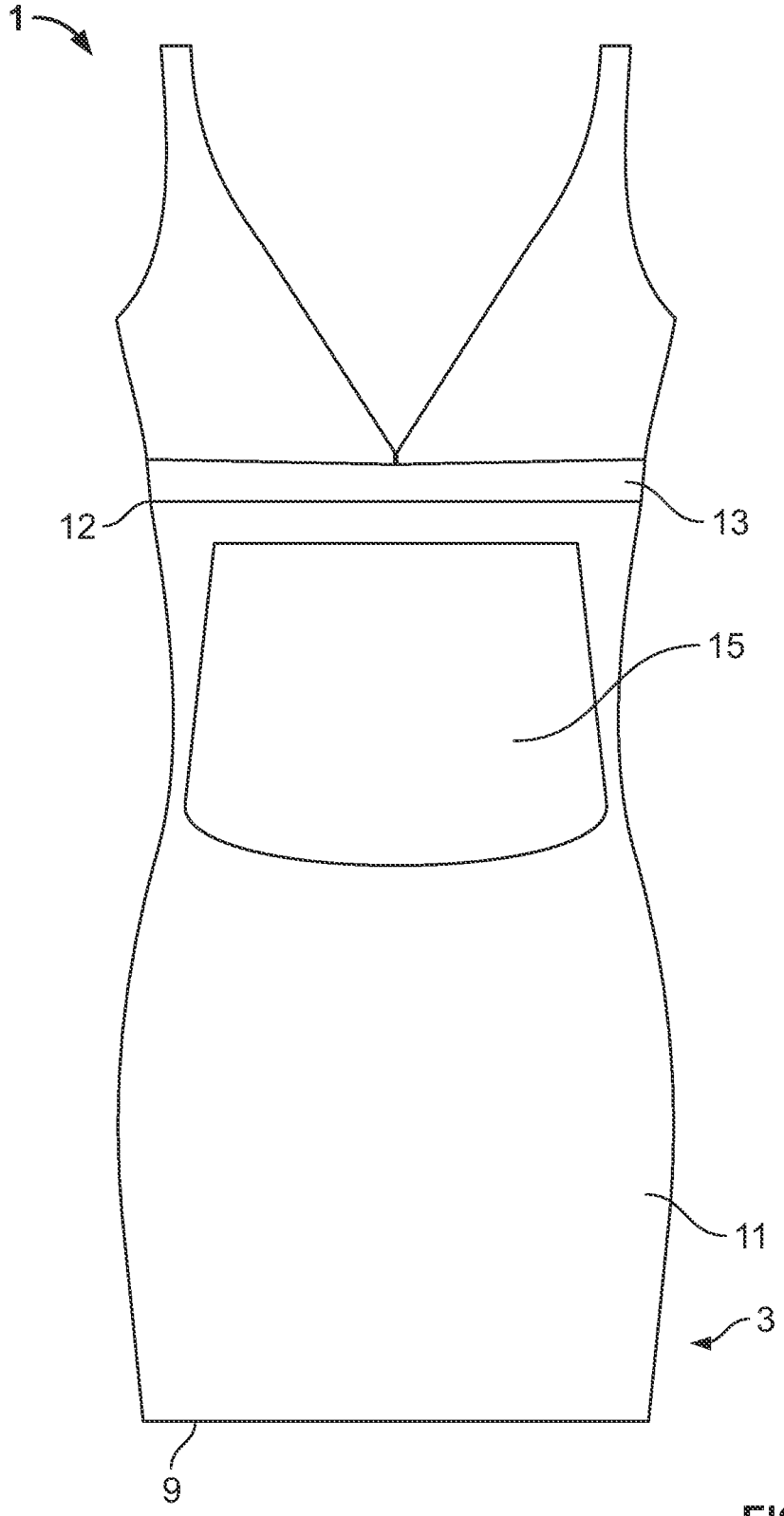
FIG. 2 shows the inside front of a full slip embodiment with integrated gripping technology.

FIG. 1 shows the front, outside of a full slip garment 1 having integrated gripping technology. The full slip garment 1 has a lower region 3, a middle region 5, and an upper region 7. FIG. 2 shows the front inside of the full slip garment 1 shown in FIG. 1. The lower region 3 contacts and extends upward from the lower edge 9 of the full slip garment 1. The interior surface 11 includes exposed elastic threads that directly contact the body of the wearer. As used herein, an elastic thread comprises an elastomer (for example, a polyurethane elastomer). For example, the elastic threads may comprise elastane, spandex, or Lycra®. The fabric is knit such that the elastic threads are exposed to one side of the fabric. This is in contrast to conventional knitting methods, where elastic threads are hidden within the knitting construction of the fabric and not exposed to the exterior.

The exposure of these elastic threads increases the coefficient of friction of the interior surface 11, which, in turn, reduces sliding of the interior surface 11 against the wearer's skin. The exposure of the elastic threads to interior surface 11 can extend around the entire lower region 9 in order to keep the entire lower edge 9 of the garment 1 in place. The exposure of the elastic threads eliminates the need for polymer strips, adhesives, beads, or any other gripping technology on the interior surface 11 to keep the garment in place. As such, the interior surface 11 of the lower region 3 is devoid of any coatings having a higher coefficient of friction than the interior surface 11 itself. In some embodiments, the lower edge 9 of the garment is a free-cut edge, devoid of horizontal seams or bonding to secure the threads of the fabric. The free-cut nature of the lower edge 9 provides a smooth transition from the garment to the skin.

The superior edge 12 of the middle region 7 can optionally be attached to a waistband 13, as shown in FIG. 2. In some embodiments, a friction-reducing layer 15 can be applied to the interior surface, for example, in the middle region 7 of the garment. The friction-reducing layer 15 covers the high friction elastic fibers. The friction-reducing layer 15 can be, for example, a separate piece of fabric laminated to the interior surface of the garment, or it can be a coating applied to the interior surface of the garment. Regardless of how it is applied, the addition of the friction-reducing layer 15 at certain locations can make it easier to put on and take off the otherwise high-friction garment by allowing the fabric to slide easily against the skin in particular locations. Advantageously, the friction-reducing layer 15 can also increase the rigidity of the fabric to provide structure and compression to targeted regions of the wearer's body. The friction-reducing layer 15 is shown as being applied in the middle region 5 in FIG. 2. This could provide the advantage of abdominal compression. However, the friction-reducing layer 15 can be applied in any area that would benefit from reduced friction and/or increased compression, and as such, the location of the friction-reducing layer 15 may vary according to the embodiment.

Figure 3:
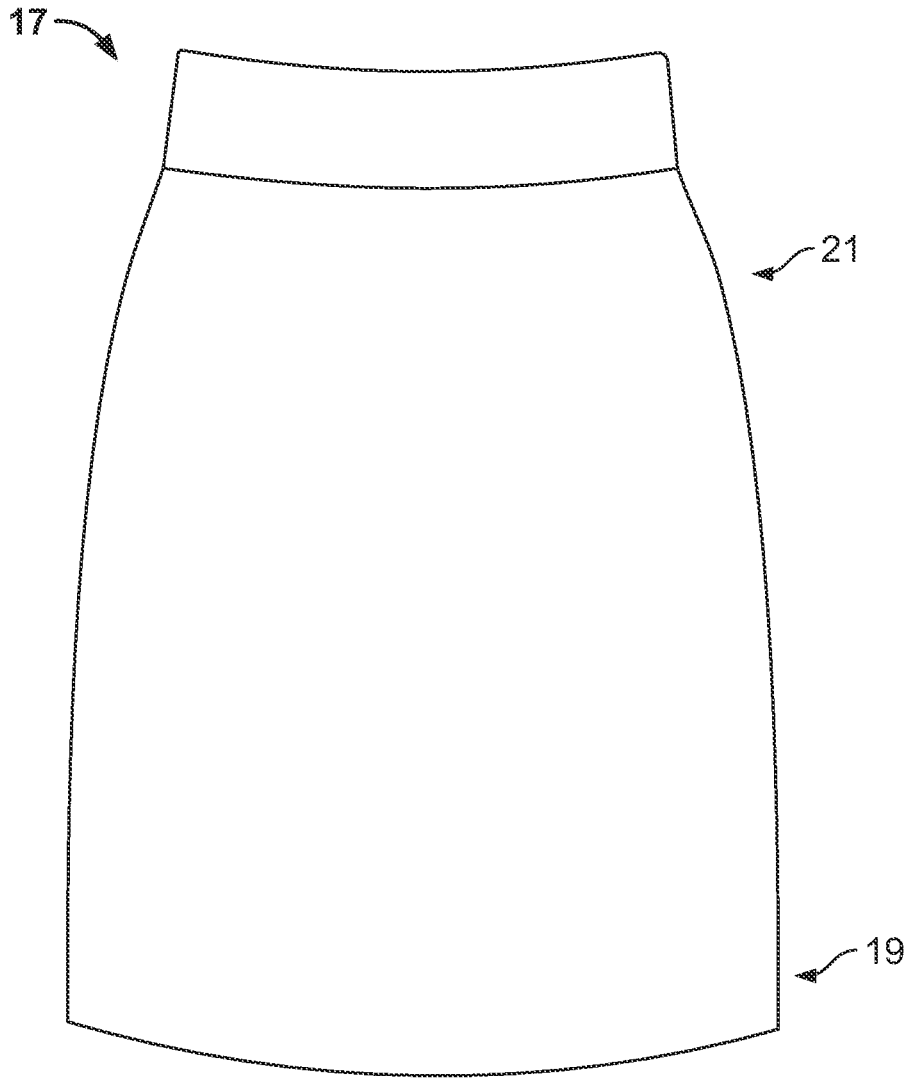
FIG. 3 shows the outside front of a half slip embodiment with integrated gripping technology.
Figure 4:
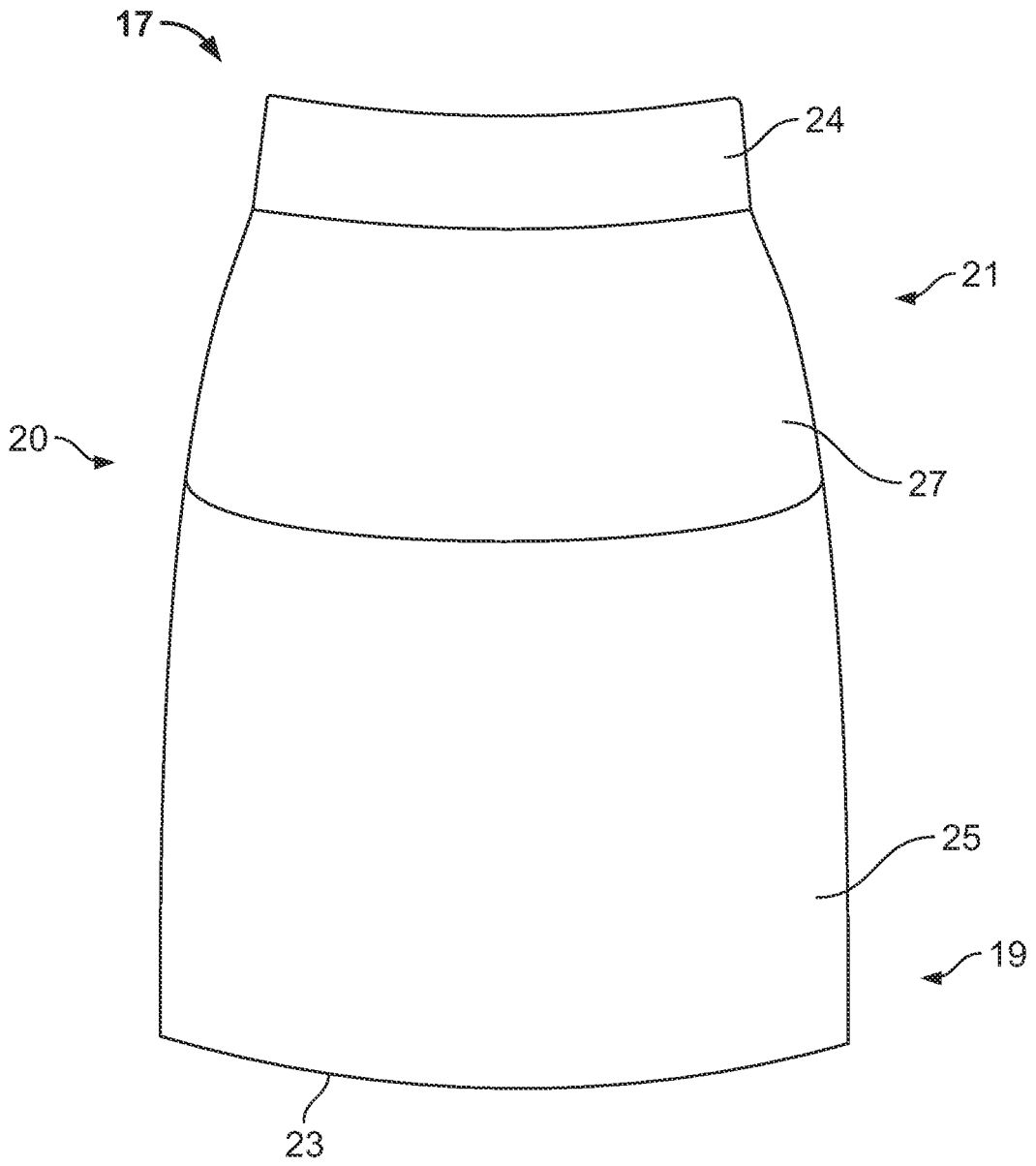
FIG. 4 shows the inside front of a half slip embodiment with integrated gripping technology.
Figure 5:
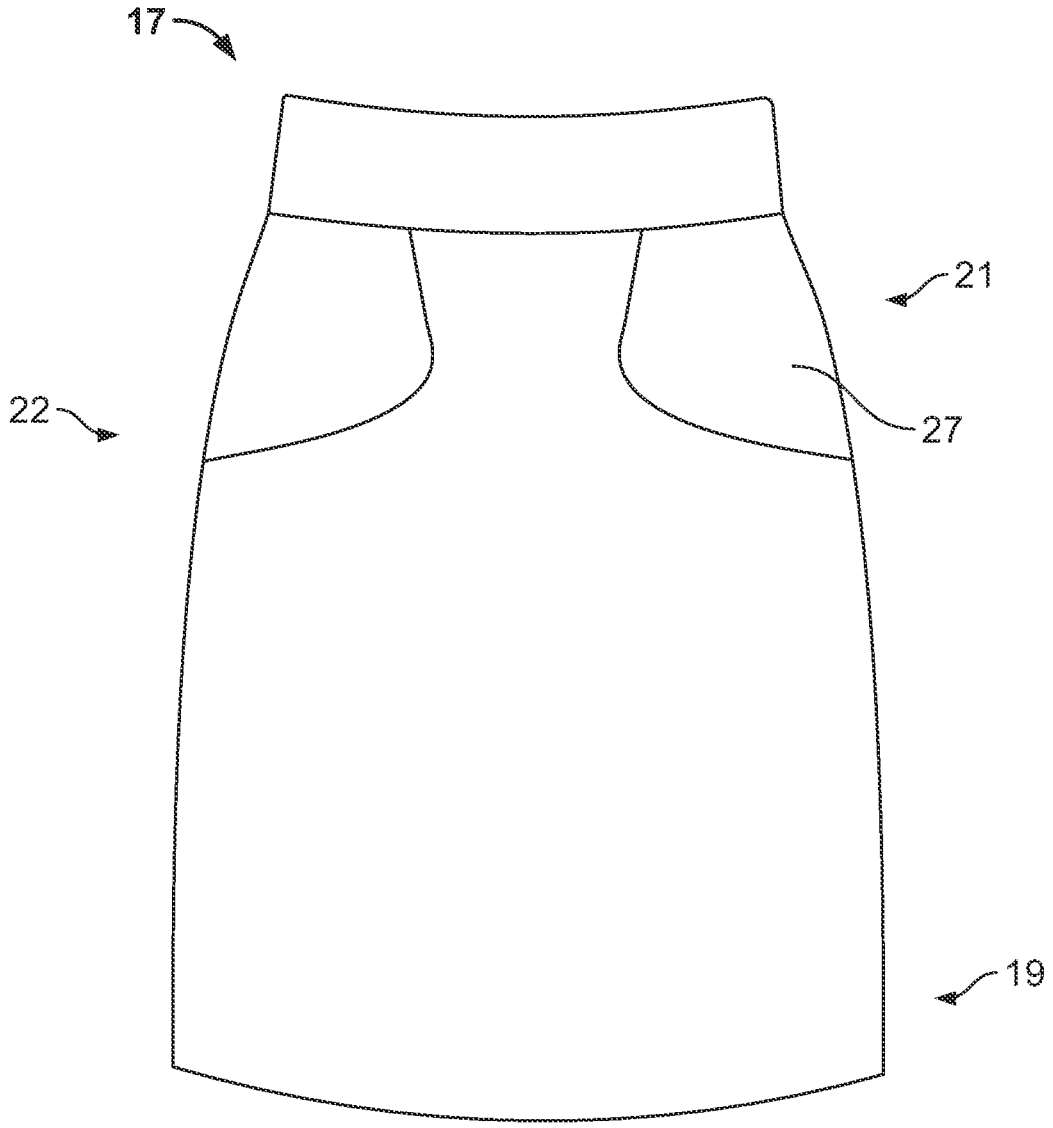
FIG. 5 shows the inside back of a half slip embodiment with integrated gripping technology.

FIG. 3 shows the front outside of a half slip garment 17 with integrated gripping technology. The half slip garment 17 embodiment includes a lower region 19 and a middle region 21. The front inside 20 of the half slip garment 17 is shown in FIG. 4. The lower region 19 contacts and extends upward from the lower edge 23 of the half slip garment 17. The interior surface 25 of the lower region 19 includes exposed elastic threads. The exposed elastic threads directly contact the body of the wearer to increase friction and reduce sliding of the lower edge, thereby helping it to stay in place. The half slip garment 17 can also have a free-cut lower edge 23, and may optionally include a friction-reducing layer 27. The friction-reducing layer 27 is positioned in the middle region 21, below waistband 24, allowing it to provide structure and compression to the abdominal region of the wearer. The placement of the friction-reducing layer 27 need not be limited to the front side of the garment, for this or any other embodiment. For example, as shown in FIG. 5, the friction-reducing layer 27 extends around to the back inside 22 of the half slip garment 17.

Figure 6A:
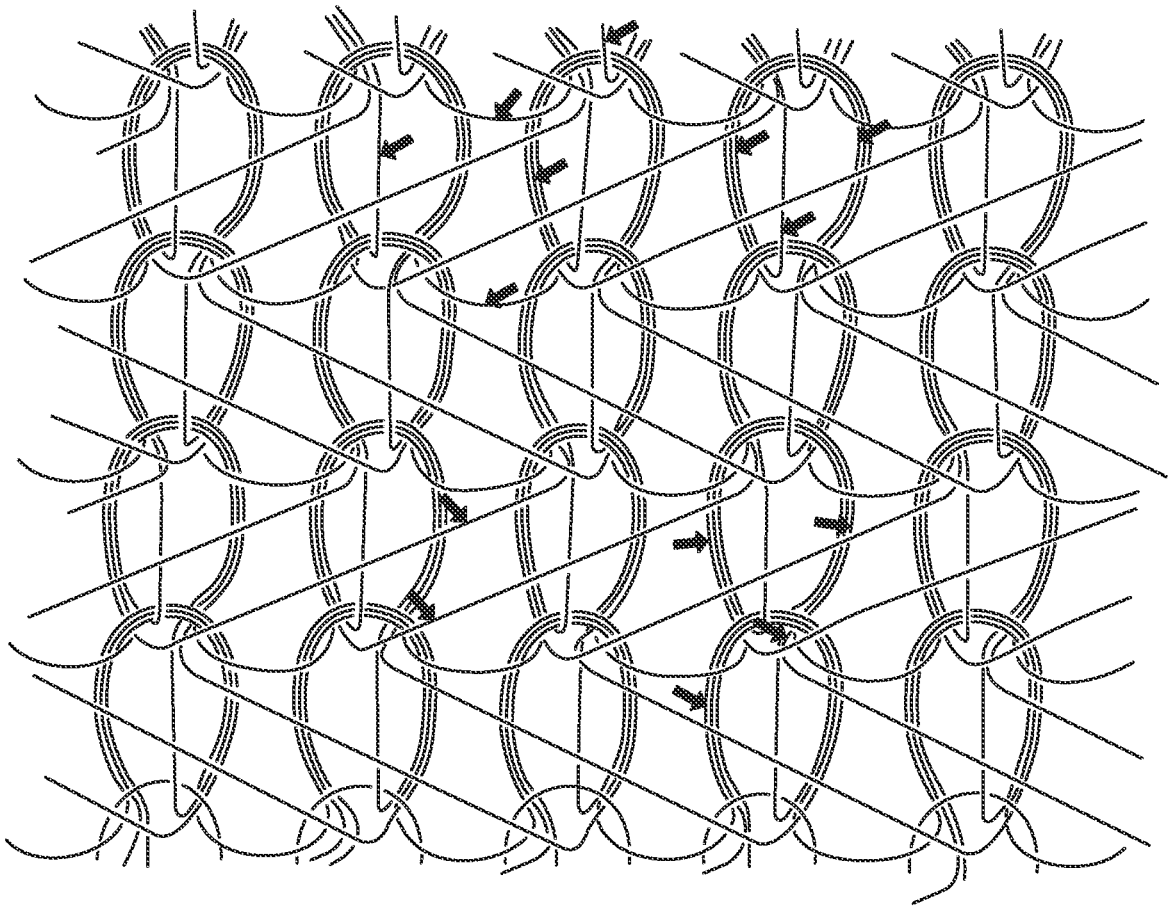
FIG. 6A shows a loop diagram of one embodiment of the construction of a fabric with integrated gripping technology.

In some embodiments, the fabric with exposed elastic threads is a knit fabric. The fabric can be warp knit, circular knit, or double knit. The fabric is knit such that the elastic threads are exposed to one side of the fabric. This is in contrast to conventional knitting methods, where elastic threads are hidden within the knitting construction of the fabric and not exposed to the exterior. FIGS. 6-8 show alternative knit construction patterns that can be utilized to form the fabric with exposed elastic threads. FIGS. 6A and 6A show the construction of an embodiment of a fabric that is made using a warp knitting machine. FIG. 6A is a loop diagram of an embodiment of the fabric of the garment. FIG. 6A is a lapping diagram of the embodiment of the fabric shown in FIG. 6A. FIGS. 7A and 7B show the construction of an alternate embodiment of a fabric made using a warp knitting machine. FIG. 7A is a loop diagram of an alternate embodiment of the fabric of the garment. FIG. 7B is a lapping diagram of the embodiment of the fabric shown in FIG. 7A.

Figure 6B:
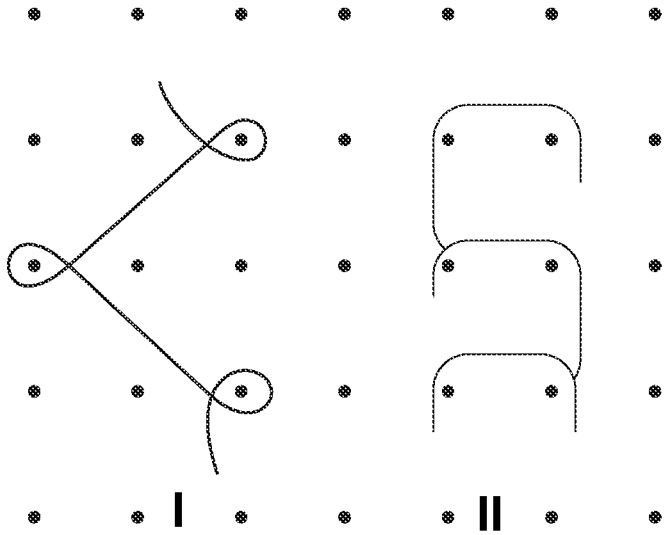
FIG. 6B shows the lapping diagram of the embodiment of construction shown in FIG. 6A.
Figure 7A:
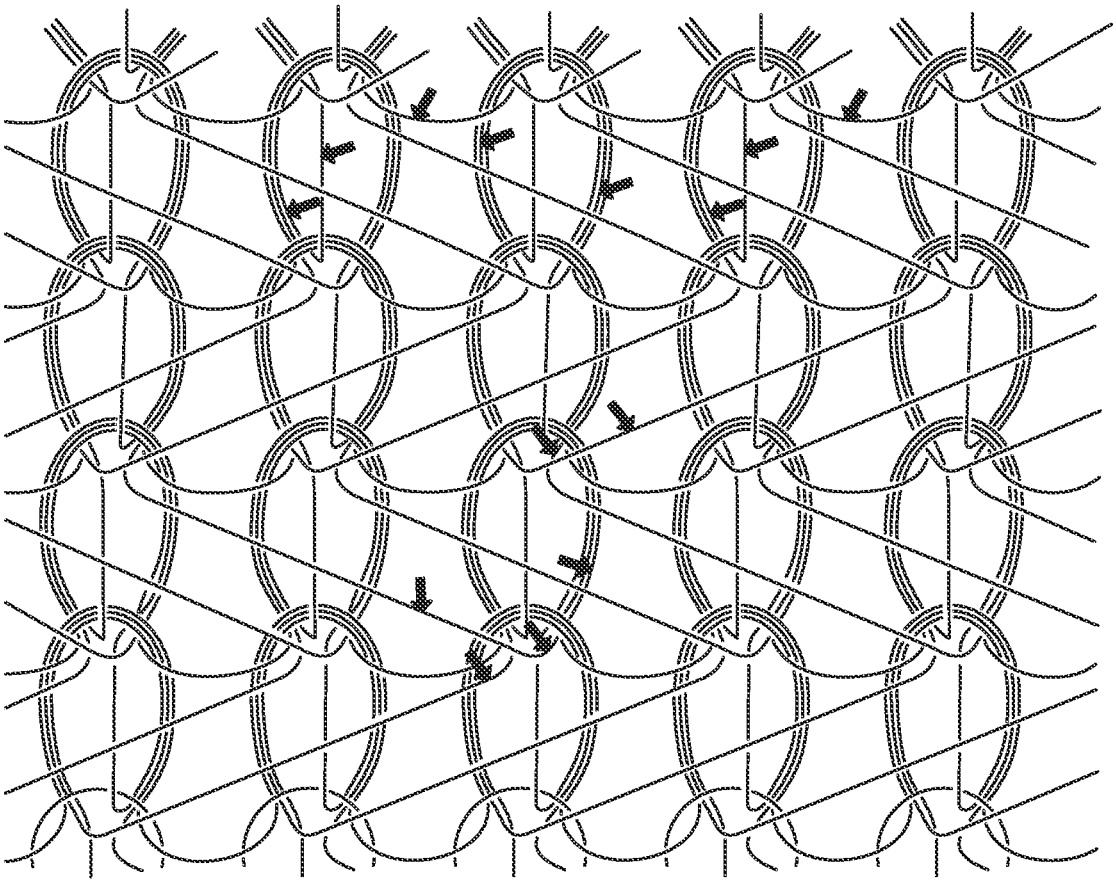
FIG. 7A shows a loop diagram of another embodiment of the construction of a fabric with integrated gripping technology.
Figure 7B:
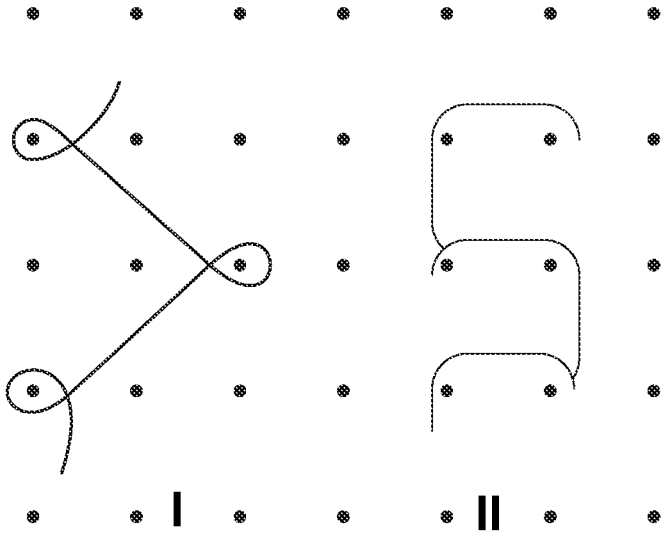
FIG. 7B shows the lapping diagram of the embodiment of construction shown in FIG. 7A.
Figure 8:
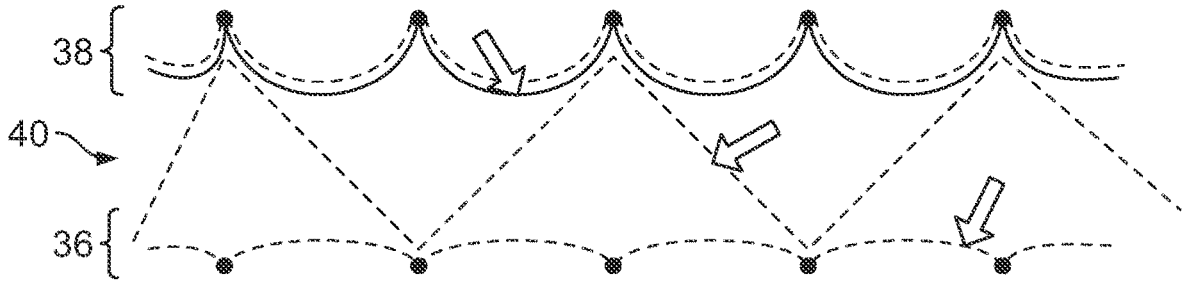
FIG. 8 shows another embodiment of the construction of a fabric with integrated gripping technology.

Two types of fibers are used to produce the fabric shown in FIGS. 6 and 7. The left-pointing arrowheads in FIG. 6A and in FIG. 7A point to and contact elastic threads. In the lapping diagrams of FIGS. 6B and 7B, the left hand thread marked I is the non-elastic thread, and the right hand thread marked II is the elastic thread. As mentioned above, the elastic threads include an elastomer, for example, a polyurethane elastomer such as elastane, spandex, or Lycra®. The linear density of the elastic threads can be anywhere from 20 denier to 140 denier, including, for example, 20 denier, 30 denier, 55 denier, 70 denier, 105 denier, 120 denier, or 140 denier. In one example, the elastic threads are 40 denier elastane yarns. The content of the elastomer in the fabric can be, for example, from about 30% to about 85%. In some embodiments, the content of the elastomer in the fabric is about 45%. The right-pointing arrowheads in FIGS. 6A and 7A point to and contact non-elastic threads. The non-elastic threads can be formed of a variety of materials, including, but not limited to: nylon, polyester, wool, acrylic, and/or regenerative fiber such as rayon, acetate, and/or cellulosic fiber like cotton, or a combination of any of the above.

Some embodiments may utilize spacer fabric. FIG. 8 is a cross sectional diagram of an embodiment of a spacer fabric having elastic threads exposed on inner side 36. The spacer fabric has an inner side 36, an outer side 38, and a spacer component 40. The left-pointing arrows point to dotted lines that represent elastic threads. The right-pointing arrows point to solid lines that represent non-elastic threads. The fabric shown in FIG. 8 can be made using a circular knitting machine. In an embodiment, the spacer component 40 is thin, providing minimal space between the inner and outer sides 36, 38. A thin spacer fabric helps create a smooth line on the wearer's body, and allows for a flat look underneath clothing without any bumps or bulges.

The fabric with exposed elastic threads can be formed using conventional knitting machines and then the garment can be constructed using cut and sew methods. In such an embodiment, panels of the fabric with exposed elastic threads may be attached to other components of the garment using seams. In some embodiments, the fabric with exposed elastic threads is used as the only layer of fabric forming the high friction region of the garment. For example, for the full slip and half slip embodiments shown in FIGS. 2 and 4, the high friction lower regions 3, 19 can be formed of a single layer of fabric with exposed elastic threads positioned on the interior surfaces 11, 25.

The static and kinetic coefficients of friction of the fabric can be measured using ASTM D1894. The static coefficient of friction is defined as the ratio of the force required to move one surface over another to the total force applied normal to those surfaces, at the instant that motion starts. The kinetic coefficient of friction is the ratio of the force required to move one surface over another to the total force applied normal to those surface, once motion is in progress. The coefficients of friction of fabric can be measured, for example, by sliding a material with known properties over the fabric. This material is referred to as a "sled." Data on the fabric with exposed elastic threads was generated via ASTM D1894, using a nitrile examination glove as a sled. Particularly, the sled was the palm of a Microflex Cobalt® Nitrile Examination Glove, Powder Free, Textured #N194, size XL with a slip direction of base of fingers to base of palm (AQL=1.5, length=9.5", palm thickness=0.1 millimeters, finger thickness=0.11 millimeters, shape=ambidextrous, glove interior=chlorinated, glove exterior=textured grip, tensile strength before aging=18, tensile strength after aging=14, elasticity/elongation before aging=500, elasticity/elongation after aging=400). The sled weight is about 203.7 grams. In some embodiments, the static coefficient of friction between the sled and the fabric having exposed elastic threads is from about 0.9 to about 3.0 in the warp direction (for example, from about 0.9 to about 1.5 in the warp direction). In some embodiments, the kinetic coefficient of friction between the sled and the fabric having exposed elastic threads is from about 0.9 to about 3.0 in the warp direction (for example, from about 0.9 to about 1.5 in the warp direction). In some embodiments, the static coefficient of friction between the sled and the fabric having exposed elastic threads is from about 0.9 to about 3.0 in the weft direction (for example, from about 0.9 to about 1.5 in the warp direction). In some embodiments, the kinetic coefficient of friction between the sled and the fabric having exposed elastic threads is from about 0.9 to about 3.0 in the weft direction (for example, from about 0.9 to about 1.5 in the warp direction). This coefficient of friction is higher than that of conventional garments in order to reduce sliding against the skin.

If a friction reducing layer is applied to reduce friction on portions of the garment, as shown in FIGS. 2 and 4, the coefficient of friction of that portion will less than the portion of the garment with exposed elastic threads. For example, using ASTM D1894 with the sled described above, the static coefficient of friction between the sled and the fabric having a friction-reducing coating is from about 0.4 to about 0.85 in the warp direction. In some embodiments, the kinetic coefficient of friction between the sled and the fabric having a friction-reducing layer is from about 0.4 to about 0.85 in the warp direction. In some embodiments, the static coefficient of friction between the sled and the fabric having a friction-reducing layer is from about 0.4 to about 0.85 in the weft direction. In some embodiments, the kinetic coefficient of friction between the sled and the fabric having a friction-reducing layer is from about 0.4 to about 0.85 in the weft direction.

Values for the elongation and tensile force can be determined using ASTM D4964-96(2016), Standard Test Method for Tension and Elongation of Elastic Fabrics (Constant-Rate-of-Extension Type Tensile Testing Machine). The specimen tested is a looped piece of fabric approximately 3 inches wide and 5 inches in length (from the first end of the loop to the second end of the loop). The machine speed is 500 mm/min. To test the specimens, the following procedure is used: (1) the specimen in loop form is placed around the clamps of the testing machine, which then undergoes a longitudinal pull; (2) cycle three times from zero to 100 N load; (3) record values from the third extension-load curve. The percent elongation is measured at 100 Newton (N) load (22.5 pounds). The tension is measured at 30%, 50%, and 70% elongation. The fabric with exposed elastic threads can have an elongation in the width direction of from about 30% to about 200% at a 100 N load. In the width direction, the fabric can exert a tension force of from about 1 N to about 30 N at 30% elongation, from about 2 N to about 40 N at 50% elongation, and from about 3 N to about 60 N at 70% elongation. In the length direction, the fabric with exposed elastic threads can have an elongation of from about 30% to about 200% at a 100 N load. In the length direction, the fabric can exert a tension force from about 1 N to about 30 N at 30% elongation, from about 2 N to about 40 N at 50% elongation, and from about 3 N to about 60 N at 70% elongation. In some embodiments, the fabric stretches equally in all directions, such that the elongation values in the length and width directions are similar or the same.

Disclosed herein are methods of making garments having integrated gripping technology. The methods include knitting elastic threads into a fabric such that the elastic threads are exposed to a surface of the fabric, cutting one or more panels from the fabric having exposed elastic threads, and attaching the one or more panels to other garment components such that the surface having the exposed elastic threads becomes an interior surface of the garment. For the slip garments discussed above, the panels cut from the fabric having the exposed elastic threads form the lower region of the garment. The lower region can be attached to a middle region using cut and sew methods, or the middle region can be continuous with the lower region. The superior edge of the middle region can be attached to a waistband. The step of knitting elastic threads into a fabric can be performed using warp knitting, circular knitting, or double knitting. The various components of the garment (for example, the upper region 7, the middle region 5, and the lower region 3 of the embodiment shown in FIG. 1) can be attached to each other using seams in cut and sew methods. A friction reducing layer may be applied to certain portions of the surfaces having exposed elastic threads.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The implementation was chosen and described in order to best explain the principles of the invention and the practical application, and to enable others of ordinary skill in the art to understand the invention for various implementations with various modifications as are suited to the particular use contemplated.

The invention claimed is:

1. A garment with integrated gripping technology, the garment comprising:

an upper region;

a middle region positioned below the upper region and configured to extend around at least the abdominals and lower back of a wearer;

a lower region positioned below the middle region and configured to extend around at least the upper thighs of the wearer;

a warp knit gripping fabric comprising integrally knit, exposed elastic threads configured to directly contact the body of the wearer, the gripping fabric forming at least the middle region, the lower region, and a lower edge of the garment; and a friction reducing layer coupled to a front, interior surface of the middle region so as to cover the gripping fabric of the front, interior surface of the middle region, the friction reducing layer configured to extend over and compress the abdominals of the wearer;

wherein the exposed elastic threads are exposed predominantly on interior surfaces of the garment, including a back, interior surface of the middle region and an entire interior surface of the lower region;

wherein the lower edge of the gripping fabric is a free-cut lower edge; and wherein the exposed elastic threads comprise elastane.

2. The garment of claim 1, wherein the lower region contacts and extends upward from the lower edge of the garment.

3. The garment of claim 2, wherein the interior surface of the lower region is devoid of any coatings having a higher coefficient of friction than the interior surface of the lower region.

4. The garment of claim 2, wherein the entire lower region is devoid of adhesives.

5. The garment of claim 1, wherein the gripping fabric of the lower region comprises from about 30% to about 85% elastane.

6. The garment of claim 5, wherein the gripping fabric of the lower region comprises about 45% elastane.

7. The garment of claim 1, wherein the gripping fabric of the lower region has an elongation of from 30% to 200% in the width direction at 100 N load.

8. The garment of claim 1, wherein the gripping fabric of the lower region has an elongation of from 30% to 200% in the length direction at 100 N load.

9. The garment of claim 1, wherein the gripping fabric of the lower region exerts a tension force of from 1 N to 30 N at 30% elongation, from 2 N to 40 N at 50% elongation, and from 3 N to 60 N at 70% elongation in the length direction.

10. The garment of claim 1, wherein the gripping fabric of the lower region exerts a tension force of from 1 N to 30 N at 30% elongation, from 2 N to 40 N at 50% elongation, and from 3 N to 60 N at 70% elongation in the width direction.

11. The garment of claim 1, wherein the gripping fabric of the lower region comprises a static coefficient of friction in the warp direction of from 0.9 to 3.0.

12. The garment of claim 1, wherein the gripping fabric of the lower region comprises a kinetic coefficient of friction in the warp direction of from 0.9 to 3.0.

13. The garment of claim 1, wherein the gripping fabric of the lower region comprises a static coefficient of friction in the weft direction of from 0.9 to 3.0.

14. The garment of claim 1, wherein the gripping fabric of the lower region comprises a kinetic coefficient of friction in the weft direction of from 0.9 to 3.0.

15. The garment of claim 1, wherein the garment is a half slip.

16. The garment of claim 1, wherein the garment is a full slip.

17. The garment of claim 1, wherein the gripping fabric of the lower region is formed from a single layer of fabric.

18. The garment of claim 1, wherein an elastic waistband is attached to a superior edge of the middle region.

19. The garment of claim 1, wherein the lower region is constructed using cut and sew methods.

20. A method of making a garment with integrated gripping technology, the method comprising:

integrally warp knitting elastic threads comprising elastane into a gripping fabric such that the elastic threads are exposed predominantly on a first surface of the gripping fabric;

cutting one or more panels from the gripping fabric having exposed elastic threads;

positioning the one or more panels of gripping fabric such that a free-cut edge of the gripping fabric is the lower edge of the garment;

positioning the one or more panels of gripping fabric such that the exposed elastic threads are positioned on the interior surface of the garment;

attaching the one or more panels of gripping fabric to other components to form an upper region of the garment, a middle region of the garment positioned below the upper region and configured to extend around at least the abdominals and lower back of a wearer, and a lower region of the garment positioned below the middle region and configured to extend around at least the upper thighs of a wearer; and attaching a friction reducing layer to a front, interior surface of the middle region, thereby covering the gripping fabric;

wherein the gripping fabric forms at least the middle region and lower region of the garment;

wherein the exposed elastic threads are exposed predominantly on interior surfaces of the garment, including a back, interior surface of the middle region and an entire interior surface of the lower region, and wherein the friction reducing layer is configured to extend over and compress the abdominals of the wearer.

21. The method of claim 20, wherein a superior edge of the middle region is attached to a waistband.

22. The method of claim 20, further comprising attaching two or more panels of the lower region using seams.

* * * * *